US006044983A

United States Patent [19]

Hall

[11] Patent Number: 6,044,983

[45] Date of Patent: Apr. 4, 2000

[54] SHELF STRUCTURE

[75] Inventor: Mark J. Hall, Park City, Utah

[73] Assignee: Hansen Beverage Company, Corona, Calif.

[21] Appl. No.: 09/015,595

[22] Filed: Jan. 29, 1998

[51] Int. Cl.[7] ..... A47F 5/00

[52] U.S. Cl. ..... 211/59.2; 211/90.03; 211/119.003

[58] Field of Search ..... 211/59.2, 90.03, 211/181.1, 106, 74, 119.003; 312/45, 72

[56] References Cited

U.S. PATENT DOCUMENTS

| | | | |
|---|---|---|---|
| 2,889,054 | 9/1959 | Wheeler | 211/181.1 X |
| 3,003,248 | 10/1961 | Wittie | 211/181.1 X |
| 3,203,554 | 8/1965 | Pendergrast et al. | 211/59.2 |
| 4,426,008 | 1/1984 | Olson et al. | 211/59.2 |
| 5,072,839 | 12/1991 | Arnone | 211/90.03 X |
| 5,074,420 | 12/1991 | Cappel | 211/181.1 X |
| 5,119,945 | 6/1992 | Wiggins | 211/90.03 X |
| 5,123,545 | 6/1992 | Hickman | 211/59.2 |
| 5,240,124 | 8/1993 | Buday | 211/59.2 |
| 5,607,068 | 3/1997 | Coretti, Jr. et al. | 211/59.2 |
| 5,868,263 | 2/1999 | McAllister et al. | 211/106 X |

*Primary Examiner*—Robert W. Gibson, Jr.
*Attorney, Agent, or Firm*—Ladas & Parry

[57] ABSTRACT

A shelf structure, and more particularly, a shelf structure for a so-called walk-in cooler is provided. The shelf has a front and, lower than the shelf and at least forward of the front of the shelf, is a panel structure for supporting additional items.

19 Claims, 1 Drawing Sheet

SHELF STRUCTURE

FIELD OF THE INVENTION

The invention relates to a shelf structure and, more particularly, a shelf structure for a so-called walk-in cooler.

BACKGROUND OF THE INVENTION

All shelf space is limited to the space available. This is a problem domestically and commercially. It is a particular problem for retail establishments, where success can be measured by sales per area, and for grocery and convenience stores, especially, because of the diversity of goods such stores carry. Therefore, competition among suppliers for shelf space is keen and a way of providing extra shelf space would be desirable.

Shelf space limits are even more significant in some special cases, as where the environment of the shelf is heated or cooled, for example. In such cases, not only the space available, but also the added cost of maintaining the environment about the shelf has to be considered.

In grocery and convenience stores, for example, goods such as beverages are desirably stocked in so-called visi-coolers and walk-in coolers. These coolers are refrigerated units having glass doors to display the goods. As used herein, a walk-in cooler is distinguished from a visi-cooler by having a space of several inches between the inside of its closed glass door and the fronts of the shelves for goods In the walk-in cooler.

In addition to displaying the goods, visi-coolers and walk-in coolers also stock the goods. More than one of each product is desired for successive supply. However, as goods in the front are removed, additional stocks of the goods toward the rear of the cooler become increasingly remote from the glass door that displays them and, therefore, less conspicuously offered for sale. What is an inconvenience in having to reach for a good at the back of a domestic refrigerator becomes even more undesirable in a commercial establishment.

Therefore, it is a common commercial practice to incline shelves so that successive goods move forward by gravity to the front when the good from the front is removed for sale. Shelves in visi-coolers, walk-in coolers and other places often are set in their structures by clips that engage notches that progress at intervals vertically at the corners of the shelves. In such arrangements, it is often a simple matter to set the clips for the fronts of the shelves a notch or two lower than the clips for the rears of the shelves to provide a desired incline.

With such inclined shelves for beverages, particularly, in commercial visi-coolers and walk-in coolers, it is known to stock the goods in glide racks that assure that the goods successively move down the incline in an orderly fashion that maintains their display for sale at the shelf fronts. For this, the glide racks frequently provide a row of channels across their upper surfaces that are each designed to slide a single file of goods down the incline. The fronts of the channels have lips that stop the goods from sliding off the front and the bottoms of the glide racks have structures that fix the glide racks to the shelves so that the glide racks themselves do not slide forward off the shelves. When glide racks are used, the shelves themselves may have relatively wide gaps in their structures for lightness and air circulation, for example, and the glide racks may also have openings for the same reasons, although these must be small enough to provide stable sliding support for the goods.

With inclined shelves, especially with glide racks, it is possible to limit the vertical space between shelves, because only the goods in the front have to be removed. Only limited clearance has to be provided above the goods on a shelf, because it is not necessary to reach over the tops of the front goods to remove goods from the rear of the shelf. This permits additional shelf space in the same volume of visi-cooler or walk-in cooler, for example.

Even with this addition to shelf space, however, competition for shelf space still remains keen. Therefore, a way of adding even more shelf space is still desired.

SUMMARY OF THE INVENTION

Therefore, it is an object of the invention to provide a shelf structure and a system of its use.

To these and other ends, the invention provides a shelf for supporting goods. The shelf has a front and, lower than the shelf and at least forward of the front of the shelf, is a panel structure for supporting additional items.

BRIEF DESCRIPTION OF THE DRAWING

Preferred embodiments that illustrate but do not limit the invention will now be described with reference to a drawing, in which.

DESCRIPTION OF THE PREFERRED EMBODIMENTS

Figures 1, 2:
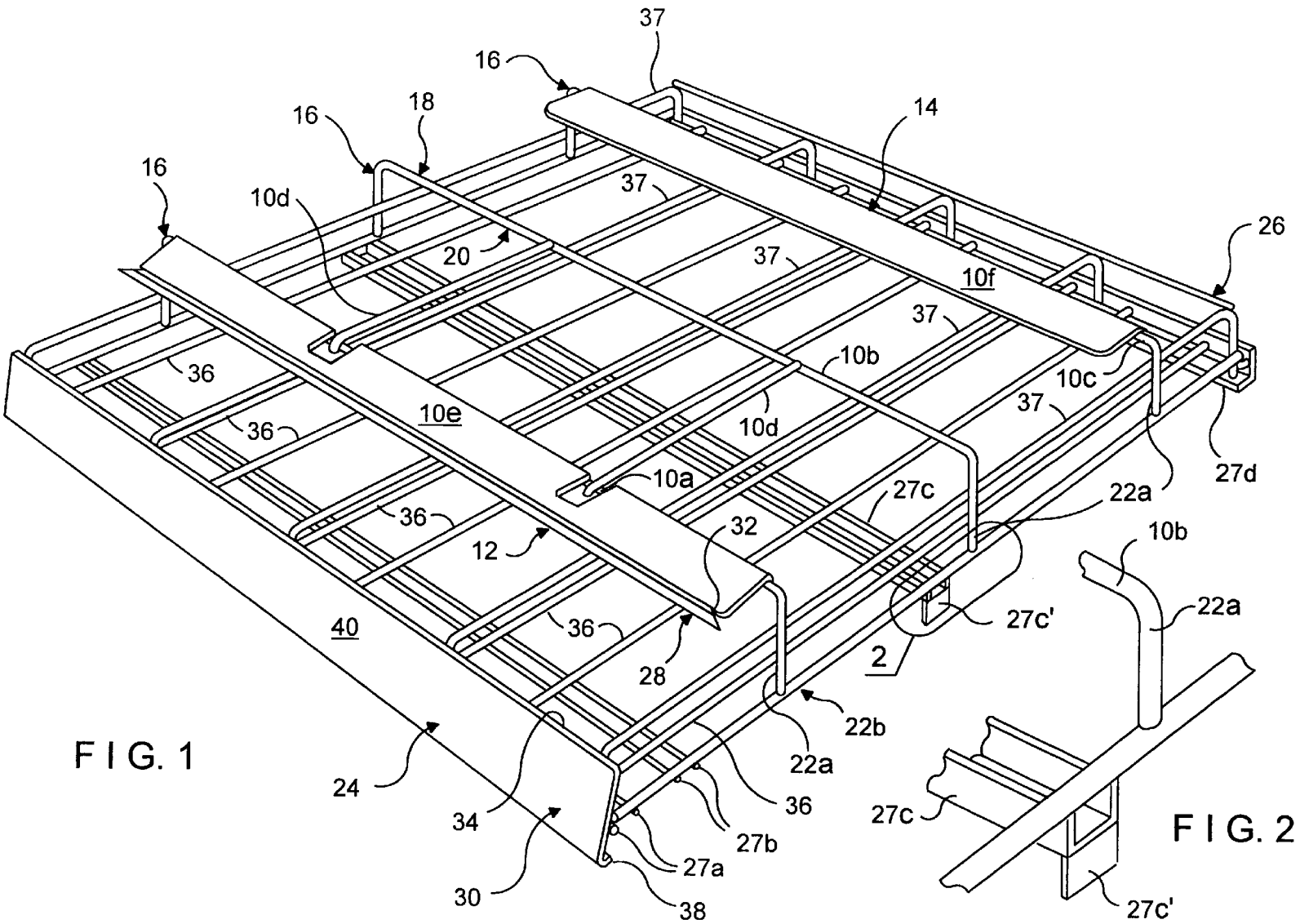
FIG. 1 is a top, front, right-side perspective view of a preferred embodiment.
FIG. 2 is an enlarged top, front, right-side perspective view of a portion thereof.

A preferred embodiment shown in FIGS. 1 and 2 has a front rod 10*a* at a front 12, a middle rod 10*b* and a rear rod 10*c* at a rear 14. The rods are parallel and define a first plane across the top side at 18 as a shelf at 16 for a glide rack to hold goods. From the Description of Use and System Thereof below, it will appear that these goods in the glide rack can be the same goods that previously were in the glide rack that was directly on a shelf of a visi-cooler or walk-in cooler beneath which additional items will be added on the extra shelf space provided by the invention.

Because the glide rack will hold the goods for this embodiment, there is substantial space between the rods that are required only to provide sufficient support strength. To assure this, the front and middle rods are connected by a pair of rods 10*d* in the plane of the shelf and panels 10*e* and 10*f* extends along the front and rear rods 10*a*, 10*c*. The panel 10*f* is substantially in the plane of the shelf but, preferably slightly higher to facilitate inserting cans at the rear 14.

Support legs 22*a* are formed by bending opposite ends of the rods 10*a*, 10*b*, 10*c* to project downward from a bottom at 20 of the shelf to lowermost ends. The support legs support the shelf at 16 above another structure (not shown) such as a shelf in a walk-in cooler, for example. However, in view of the framework at 22*b* described below, it would be equivalent in another embodiment (not shown) to have the shelf at 16 fastened under the other structure to hang the framework under the other structure, the shelf at 16 in such an arrangement also being considered herein as superimposed relative to the other structure. For example, the panels 10*e*, 10*f* could have holes (not shown) for threaded fasteners to a cooler shelf.

The lowermost ends of the support legs 22*a* are connected to the framework at 22*b*. In this embodiment, the support legs 22*a* have equal lengths so that the shelf at 16 and framework at 22*b* or, more specifically, rods 36 thereof define first and second parallel planes. In other, equivalent embodiments (not shown), however, the support legs may have unequal lengths so that the rear at 14 of the shelf at 16 is higher (more spaced from the rods 36) than the front at 12 of the shelf, for example.

The framework has a front at 24 and rear at 26 that are parallel to the front at 12 and rear at 14 of the shelf at 16. However, in other, equivalent embodiments, the fronts or rears could be angled or stepped relative to each other, At the front 24, the framework has a first pair of rods 27*a* and, spaced a little to the rear, a second pair of rods 27*b*. The pairs of rods 27*a*, 27*b* are also spaced from each other for reasons explained below.

About in the middle and at the rear of the of the framework at 22*b* are middle and rear support bars 27*c*, 27*d* of angular cross sections that extend across the framework for strength. Opposite ends of the middle support bar 27*c* in this embodiment have dependent tabs 27*c'* to engage or straddle the other structure on which the framework is supported to prevent sideways slippage. In a typical walk-in cooler, for example, the other structure (not shown) is a wire frame shelf. The tabs can then project between front-to-rear wires of the structure shelf for providing the lateral stability.

At the front 12 and on the panel 10*e* on the front rod 10*a* of the shelf at 16 is panel structure at 28 and at the front 24 of the framework at 22*b* is a panel structure at 30. Each of these panel structures provides strength and a stop.

The stop on the panel structure at 28 is the rearward face of a lip 32 formed by an upwardly (i.e., in a direction with at least a component from the second to the first plane); bent front edge of the panel structure that rises above the plane of the shelf at 16. The bend may also serve as a score line for removal of the lip 32, or another arrangement may be provided for such removal. Removal may be useful when the shelf at 16 is fastened under some the other structures (not shown) such as a visi-cooler shelf, for example, so that the shelf 16 can be abutted under the cooler shelf in the other embodiment (not shown) described above to enable the cooler shelf and framework to be substantially parallel.

The stop on the panel structure at 30 is also the rearward face of a lip 34. However, its panel structure at 30 is more extensive than the panel structure at 28 of the shelf at 16.

The panel structure at 30 has rods 36 on top of the rods 27*a*, 27*b* and support bars 27*c*, 27*d* of the framework that extend from the front at 24 to the rear at 26 of the framework. In this embodiment, these rods 36 are spaced to support the cylindrical surfaces of four files of cans (not shown), but other items of cylindrical, prismatic or other shapes could be substituted for use in equivalent fashion. Therefore, when the framework at 22*b* is supported on an inclined shelf of a walk-in cooler, for example, the cans toward the rears of the files roll down the rods 36 to the lip 34 as the cans at the front 24 are respectively removed from the files. To keep the cans in the four files, the framework at 22*b* includes three front-to-rear divider rods and lateral side rods 37 at intervals across the framework defining channels for the files of cans.

However, if the framework at 22*b* is placed on a shelf of a walk-in cooler, for example, it will be appreciated that the rods 36 of the panel structure at 30 with the lip 34 do not have to extend to the rear of the framework, The shelf of the walk-in cooler can provide the roll-down support for the cans until they reach the front of the shelf of the walk-in cooler. Therefore, in other embodiments (not shown), the panel structure at 30 that provides the lip 34 may stop in the rearward direction substantially at a projection thereon of the line of the lip 32 or only part way toward the rear at 26 of the framework in arrangements that are equivalent to that described as preferred herein.

In order to remove the cans from the front at 24, the panel structure at 28 of the lip 32 is spaced rearwardly from the lip 34 of the panel structure at 30. Therefore, the size of such rearward spacing depends on the products to be removed from behind the lip 34 and can be varied from that shown in other, equivalent embodiments (not shown).

The panel structure at 30 also has a lowermost rim 38 on a plane with the pairs of rods 27*a*, 27*b* of the framework at 22*b* or, as shown, somewhat therebelow. It also has a front panel 40 that is shown substantially vertical, but preferably, in another embodiment (not shown), is curved for aesthetic complement to the can goods with which the embodiment may be used. Variations in the vertical profile of the front panel 40 are equivalents.

The framework at 22*b* may also include other reinforcements, some of which are shown in the drawing, or others. Such variations in the framework are equivalents.

The framework at 22*b* is only one of many possible ways to arrange the supports 22*a* for a particular use. Other arrangements would be equivalent, such as the hanging arrangement already described above, for example. Various rods and bars described and shown for the preferred embodiment are considered desirable, but are not required in the forms described or shown. Other forms are equivalent. These rods and bars and other parts of the preferred embodiment are preferably coated metal, but plastic or other materials may also be used.

Variations, combinations or permutations as would occur to those skilled in the art are equivalent element-by-element to the described preferred embodiments.

Description of Use and a System Thereof

Use of the described shelf structure on a horizontal or inclined shelf of a visi-cooler or walk-in cooler has already been suggested. When the cooler shelf or other supporting structure is horizontal, it is desirable to put a block or wedge on the cooler shelf under the rear at 26 of the framework or the heights of the vertical supports 22*a* increase from front to rear to provide the incline to the shelf at 16 and the rods 36 that will cause the goods and cans or other items to move to the fronts at 12 and 24 as described above. When the cooler shelf or other supporting structure is inclined, the described shelf sturcture can be placed directly theron to utilize its incline. Other ways of using the described shelf structure are contemplated and still more may occur to those in the art.

In a visi-cooler that has no space between the inside of its closed glass door and the fronts of its horizontal or, usually, inclined shelves, the rim 38 of the panel structure at 30 is abutted behind a ridge on the front of one of the cooler shelves or, preferably, the ridge is straddled between the rim 38 and the foremost rod of the pair of rods 27*a* or by the first pair of rods 27*a* on the framework so that the shelf structure does not slide down the incline of the shelf of the visi-cooler and still fits behind its closed glass door.

Items, such as the four files of cans previously described, are then placed on the rods 36 at the rear 26 of the framework to roll or slide down the incline to the lip 34 of its panel structure at 30. Particularly when the items are horizontally arranged cans to roll down the incline, it will be appreciated that the height of the supports 22*a* can be limited to provide a clearance between the rods 36 and the underside 20 of the shelf substantially the diameter of the cans. If, in a marketing strategy, cans are provided with a diameter slightly smaller than the typical beverage can, for example about 2 inches in diameter as opposed to about 2.5 inches for a typical beverage can, then it will be appreciated that substitution of such typical beverage cans by competitors can be prevented by making the clearance provided by the supports 22*a* sufficient to accommodate only the smaller diameter cans.

It will be appreciated by those in the industry that one beverage can is often substituted in the cooler space of another in the keen competition for shelf space. Therefore, providing a restrictive clearance with the lengths of the supports 22*a* is a marketing advantage to the supplier of beverages in such smaller-diameter cans in that it prevents competitor's substitution of larger cans.

Moreover, it has already been pointed out that the rearward spacing of the panel structure at 28 from the lip 34 provides the front-to-rear clearance in the downward direction at the front 24 that permits goods to be lifted off vertically from behind the lip 34 of the panel structure at 30. Therefore, the rearward spacing of the panel structure from the lip 34 can be sized relative to the smaller-than-usual product size preferably in addition to but also alternatively to the clearance provided by the supports 22*a*, as before described, it being understood that finger room to lift items out at the front 24 also is desirable.

The front panel 40 can carry indicia of the items to be stocked behind it. Such indicia can be fixed as part of a marketing system for smaller-than-usual cans, for example, but also can be variable. In either case, the front panel will be at the inside of the glass door of the visi-cooler, as described above, for conspicuous display of its indicia.

When the shelf structure is used as preferred in a walk-in cooler that has a space between the inside of its glass door and the fronts of its shelves, the shelf structure can be placed so that a ridge on the front of one of the cooler shelves is between the second, rearward pair of rods 27*b*. This will put the front panel 40 into the space between the shelf of the walk-in cooler and the inside of its closed glass door for more prominent display of the indicia thereon, visual sight of the items behind the front panel and clear vertical access to the items behind the front panel in the space between the front panel and the rearwardly spaced front at 12 of the shelf. Further, this takes advantage of the space for additional increase of the shelf area in the walk-in cooler.

The shelf area in either a visi-cooler or a walk-in cooler is increased because the shelf structure requires only a minimum space for the vertical clearance between its shelf 16 and the shelf of the cooler. This is augmented by designing the shelf structure in a system with particular items, such as the smaller-than-usual diameter cans described above but also is a consequence of the system.

Such a system further contemplates, as is usually the case, that there is enough vertical clearance at least in total between the goods on vertically successive shelves in a cooler and its shelves to accommodate at least one shelf structure of the type described. This permits the addition of the shelf structure and its additional items to the cooler without substituting for or even displacing any of the goods already therein merely by arranging the pre-existing shelves of the cooler closer together for providing vertical clearance for the shelf structure and placing the goods that had been on one of the shelves of the cooler or a glide rack thereon in the same glide rack on the shelf of the shelf structure as described above. The cooperation in such a system of the minimum clearance of the shelf structure and the smaller-than-usual items therefor is apparent.

Those in the art will appreciate that the above effect is usually achieved easily, because of different heights of goods on the preexisting shelves of a cooler. By arranging these goods by heigh in an efficient manner, the space above uniformly sized goods on a shelf can be used to accommodate the shelf structure described herein directly or, more likely, by adjusting the relative vertical positions of the pre-existing shelves in the cooler. This also cooperates with a modular concept of the system.

It will be appreciated that nothing has been said above about the relative widths of the pre-existing shelf structure in a cooler or other structure on which the disclosed shelf structure is used. It may be that, as a rule, the shelf structure cannot be wider than the pre-existing cooler shelf for which it is intended, but it can be narrower. When it is narrower than the pre-existing cooler shelf, taller goods on that shelf can be retained on the pre-existing shelf while the shelf structure is inserted under shorter goods. The shelf structure then doubles the pre-existing shelf area it covers. Therefore, there is advantage in having the disclosed shelf structure in modules of widths less than the widths of the pre-existing cooler shelves on which they may be used. A single module or lateral combination of modules can then be used to leave a lateral space on the pre-existing shelf for taller goods and/or more than one of the shelf structure modules laterally side by side on a cooler shelf can utilize the full width of the cooler shelf.

In a marketing system, the goods already on pre-existing shelves of a cooler can be inspected to find a space above shorter goods. A shelf structure of one or more modules can then be assembled to have the same width as taken up on the pre-existing cooler shelf by the shorter goods and the shelf structure inserted thereunder or under the shelf above. The shorter goods then remain and additional items such the four files of cans suggested above can be inserted thereunder or above. Because goods on a pre-existing cooler shelf are retained, nothing is lost, but thanks to the system, additional shelf space for additional items is provided by the disclosed shelf structure.

I claim:

1. In one of a cooler, visi-cooler, walk-in cooler and glass-door cooler having fixed or adjustable shelves, the improvement comprising:

a shelf structure on or under one of the shelves, wherein the shelf structure comprises:

a front rod-like member (10*a*) and at least one other rod-like member (10*b*, 10*c*) rearwardly spaced from the front rod-like member (10*a*) and, together with the front rod-like member (10*a*), defining a first plane (16);

a framework (22*b*) defining a second plane; and at least one support (22*a*) connecting at least the front rod-like member (10*a*) and the framework (22*b*), wherein at least a portion of the framework (22*b*) extends at least forward of a projection of the front rod-like member (10*a*) thereon with a stop (34) in a direction from the second plane with at least a component toward the first plane (16).

2. The shelf structure according to claim 1, and further comprising at least one member connecting the front and other rod-like members.

3. The shelf structure according to claim 1, wherein the at least one support comprises legs extending from opposite ends of the front and other rod-like members.

4. The shelf structure according to claim 2, wherein the at least one support comprises legs extending from opposite ends of the front and other rod-like members.

5. A shelf structure comprising:

a front rod-like member (10*a*) and at least one other rod-like member (10*b*, 10*c*) rearwardly spaced from the front rod-like member (10*a*) and, together with the front rod-like member (10*a*), defining a first plane (16);

a framework (22*b*) defining a second plane; and at least one support (22*a*) connecting at least the front rod-like member (10*a*) and the framework (22*b*), wherein at least a portion of the framework (22*b*) extends at least forward of a projection of the front rod-like member (10*a*) thereon with a stop (34) in a direction from the second plane with at least a component toward the first plane (16), and wherein the framework comprises further rod-like members extending from one end at the stop to an opposite end that is rearward of a rearward most one of the at least one other rod-like member.

6. The shelf structure according to claim 2, wherein the framework comprises further rod-like members extending from one end at the stop to an opposite end that is rearward of a rearward most one of the at least one other rod-like member.

7. The shelf structure according to claim 3, wherein the framework comprises further rod-like members extending from one end at the stop to an opposite end that is rearward of a rearward most one of the at least one other rod-like member.

8. The shelf structure according to claim 4, wherein the framework comprises further rod-like members extending from one end at the stop to an opposite end that is rearward of a rearward most one of the at least one other rod-like member.

9. The shelf structure according to claim 1, and further comprising a front panel at a front side of the stop, whereby to carry indicia corresponding to items on the framework.

10. The shelf structure according to claim 2, and further comprising a front panel at a front side of the stop, whereby to carry indicia corresponding to items on the framework.

11. The shelf structure according to claim 3, and further comprising a front panel at a front side of the stop, whereby to carry indicia corresponding to items on the framework.

12. The shelf structure according to claim 4, and further comprising a front panel at a front side of the stop, whereby to carry indicia corresponding to items on the framework.

13. The shelf structure according to claim 5, and further comprising a front panel at a front side of the stop, whereby to carry indicia corresponding to items on the framework.

14. A shelf structure, comprising:

a front rod-like member (10*a*) and at least one other rod-like member (10*b*, 10*c*) rearwardly spaced from the front rod-like member (10*a*) and, together with the front rod-like member (10*a*), defining a first plane (16);

a framework (22*b*) defining a second plane; and at least one support (22*a*) connecting at least the front rod-like member (10*a*) and the framework (22*b*), wherein at least a portion of the framework (22*b*) extends at least forward of a projection of the front rod-like member (10*a*) thereon with a stop (34) in a direction from the second plane with at least a component toward the first plane (16), and further comprising members on the front and other rod-like members for fixing the framework under another structure.

15. The shelf structure according to claim 2, and further comprising members on the front and other rod-like members for fixing the framework under another structure.

16. The shelf structure according to claim 3, and further comprising members on the front and other rod-like members for fixing the framework under another structure.

17. The shelf structure according to claim 4, and further comprising members on the front and other rod-like members for fixing the framework under another structure.

18. The shelf structure according to claim 5, and further comprising members on the front and other rod-like members for fixing the framework under another structure.

19. The shelf structure according to claim 9, and further comprising members on the front and other rod-like members for fixing the framework under another structure.

* * * * *